US006795682B2

(12) United States Patent
Nakahara

(10) Patent No.: US 6,795,682 B2
(45) Date of Patent: Sep. 21, 2004

(54) IMAGE FORMING APPARATUS INCLUDING A CLEANING UNIT

(75) Inventor: Tomotoshi Nakahara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/375,086

(22) Filed: Feb. 28, 2003

(65) Prior Publication Data

US 2003/0180076 A1 Sep. 25, 2003

(30) Foreign Application Priority Data

Feb. 28, 2002 (JP) ..... 2002-052716

(51) Int. Cl.[7] ..... G03G 21/00
(52) U.S. Cl. ..... 399/353; 399/358
(58) Field of Search ..... 399/252–256, 399/353–355, 349, 358; 15/256.5, 256.51, 256.52

(56) References Cited

U.S. PATENT DOCUMENTS 5,258,813 A 11/1993 Nakahara et al.
5,280,362 A 1/1994 Noguchi et al.
5,541,029 A 7/1996 Iwata et al.
5,640,229 A 6/1997 Nakahara
5,671,476 A * 9/1997 Ishiguro et al. ..... 399/354
5,869,213 A 2/1999 Iwata et al.
6,393,241 B1 5/2002 Matsumoto et al.
6,415,129 B2 * 7/2002 Sawayama ..... 399/353
6,493,532 B2 12/2002 Nakahara et al.
6,501,913 B2 12/2002 Hattori et al.
6,507,720 B2 1/2003 Kabumoto et al.
6,560,438 B2 5/2003 Kosuge
6,615,013 B2 * 9/2003 Arai et al. ..... 399/253

FOREIGN PATENT DOCUMENTS

JP 07-306619 11/1995

* cited by examiner

*Primary Examiner*—William J. Royer
(74) *Attorney, Agent, or Firm*—Oblon, Spivak, McClelland, Maier & Neustadt, P.C.

(57) ABSTRACT

A cleaning brush, which cleans excess toner on a photosensitive drum, has bristles that slant in the direction opposite to the direction of a developer transference by transferring screws located near a developing roller.

2 Claims, 4 Drawing Sheets

IMAGE FORMING APPARATUS INCLUDING A CLEANING UNIT

BACKGROUND OF THE INVENTION

1) Field of the Invention

The present invention relates to an image forming apparatus that uses electrophotography, like a copier apparatus, a facsimile apparatus or a printer.

2) Description of the Related Art

Conventionally, in an image forming apparatus, the slant of the bristle on a cleaning brush is a standard problem. To eliminate the unevenness of the coating of toner on a photosensitive drum arising due to the slant of the bristle on the cleaning brush, in some of the conventional image forming apparatuses an arrangement is provided that makes it possible to adjust the pressure of a lubricant in order. The cleaning brush and a cleaning blade that is included in a cleaning unit of the photosensitive drum removes the excess toner from the photosensitive drum. However, due to the presence of a slant of the bristle on the cleaning brush (the direction of the slant of the bristle on the cleaning brush is assumed to be towards the back), the toner is transferred on to the photosensitive drum in the direction opposite to the direction of the slant of the bristle on the cleaning brush. Due to this, the toner quantity picked by the cleaning blade varies, causing a difference in the frictional resistance between the cleaning blade and the photosensitive drum in the front and in the back.

Particularly, in the case in which the lubricant is externally added to the toner, the refilled toner gets consumed from the direction of the transference of the toner by a transfer screw in a developing unit. Due to this, the quantity of the lubricant that gets transferred to the photosensitive drum varies, the quantity of the lubricant being large in the front and diminishing towards the back. Hence, the lubricant is found in abundance in the toner on the side where a toner container is situated, that is, the front, and no lubricant is found in the toner on the opposite side, that is, the back. This causes a difference in the scraping of the photosensitive layer of the photosensitive drum in the front and the back. That is, the photosensitive layer on the back is lost early because of less lubricant, leading to imperfect cleaning.

SUMMARY OF THE INVENTION

It is an object of the present invention to provide an image forming apparatus that solves at least the problems mentioned above.

The image forming apparatus according to one aspect of the present invention comprises a photosensitive drum; a developing unit that causes a toner to adhere to the photosensitive drum, the developing unit including transferring screws that transfer a developer in the developing unit in a certain direction, and a developing roller situated near the transferring screws; and a cleaning unit that cleans excess toner on the photosensitive drum, the cleaning unit including a cleaning brush, wherein the cleaning brush has bristles that slant in the direction opposite to the direction of the developer transference by the transferring screws.

The image forming apparatus according to another aspect of the present invention comprises a photosensitive drum; a developing unit that causes a toner to adhere to the photosensitive drum; and a cleaning unit that cleans excess toner on the photosensitive drum, the cleaning unit including an excess toner removing coil that transfers excess toner in a certain direction, and a cleaning brush, wherein the cleaning brush has bristles that slant in the direction that is opposite to the direction of excess toner transference in the excess toner removing coil.

These and other objects, features and advantages of the present invention are specifically set forth in or will become apparent from the following detailed descriptions of the invention when read in conjunction with the accompanying drawings.

DETAILED DESCRIPTIONS

Figure 1:
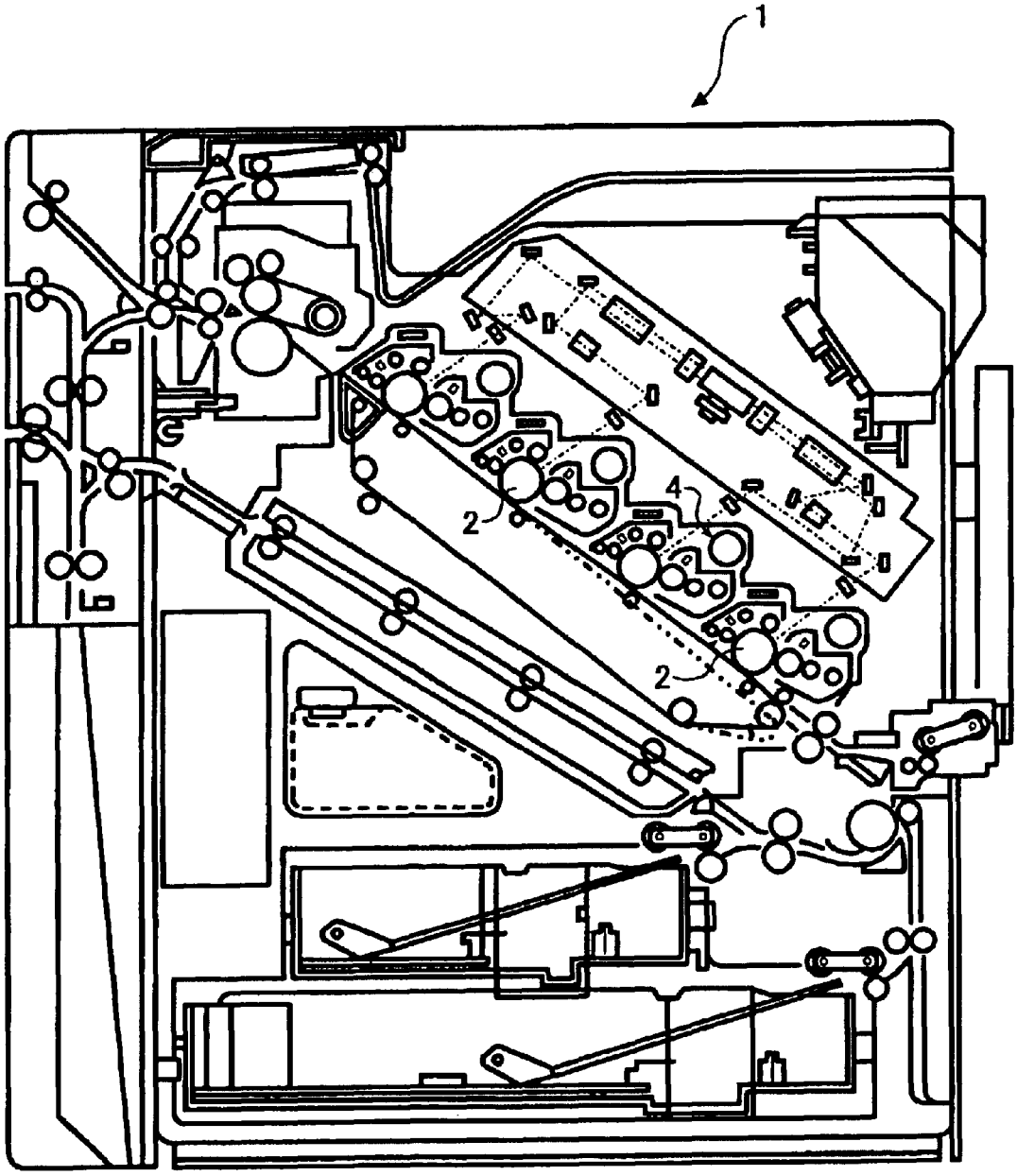
FIG. 1 is a schematic diagram of an exemplary embodiment of the present invention.
Figure 2:
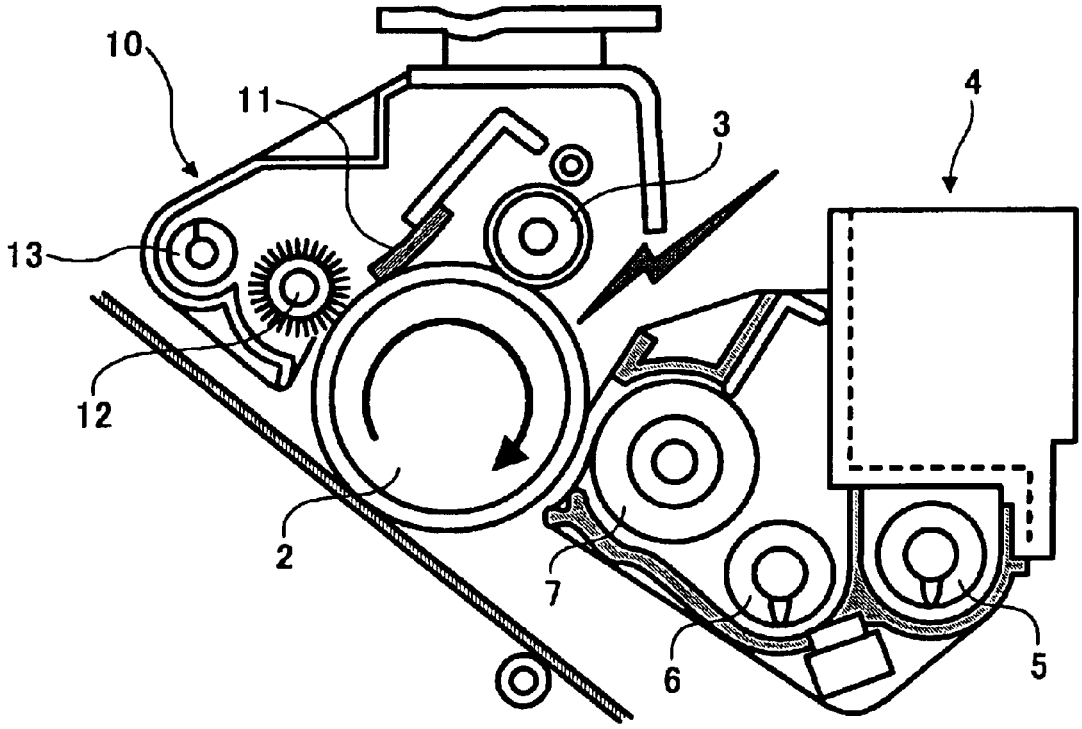
FIG. 2 is a vertical section elevation diagram of the relevant parts of FIG. 1.

Exemplary embodiment(s) of the present invention are explained with reference to the accompanying drawings. For the sake of the explanation, it is assumed here that, the image forming apparatus according to the present invention is a printer or a copier that forms color images by superimposing four colors.

FIGS. 1 to 5 show the image forming apparatus according to the present invention. In these figures, a reference numeral 1 is an image forming apparatus, 2 is a photosensitive drum, 3 is a charging roller, 4 is a developing unit, 5 and 6 are toner transferring screws, 7 is a developing roller, 8 and 9 are gears, 10 is a cleaning unit, 11 is a cleaning blade, 12 is a cleaning brush, 13 is an excess toner removing coil, and 14 is an outlet for excess toner.

The charging roller 3 uniformly charges the photosensitive drum 2. A not shown exposing unit forms an electrostatic latent image on the photosensitive drum 2. The developing roller 7 in the developing unit 4 develops the electrostatic latent image on the photosensitive drum 2 by using a toner. After the toner image is transferred to a not shown transfer material, the cleaning blade 11 and the cleaning brush 12 clean the toner left behind on the photosensitive drum 2.

Figure 3:
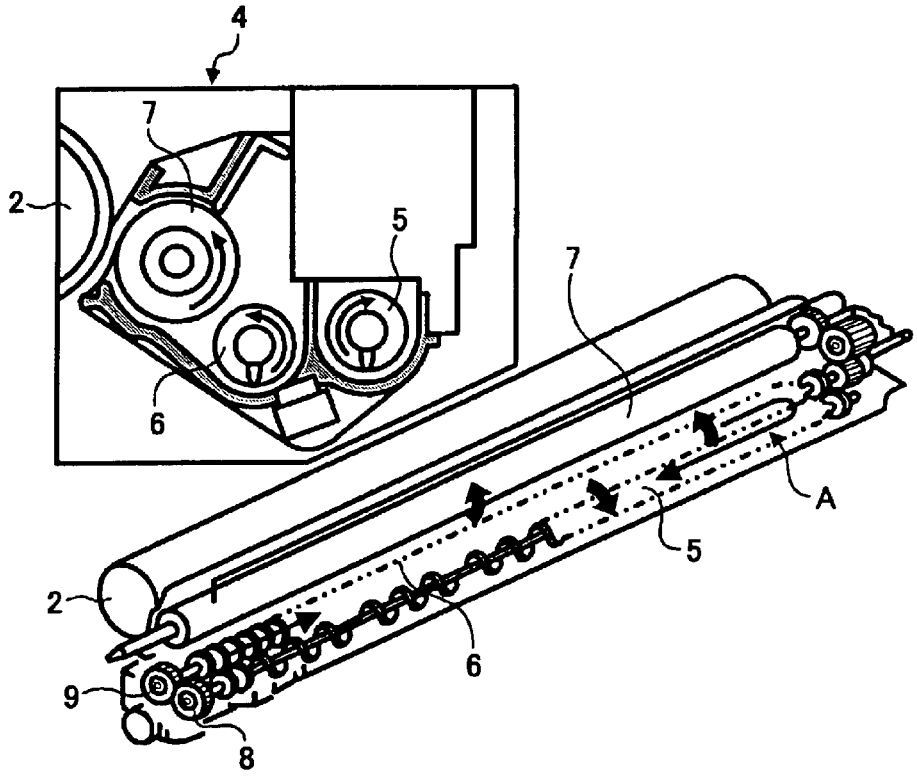
FIG. 3 is a working explanation of a developing unit.

The developer in the developing unit 4 is transferred to the developing roller 7 by the toner transferring screws 5 and 6. As shown in FIG. 3, the toner from the not shown toner supplier is supplied through the toner transferring screw 5 on the right to the back in the direction of transference. In this way, the toner is circulated inside the developing unit 4 as shown by the arrow A. Therefore, the developer that has more concentration of toner is supplied first to the front of the developing roller 7 in the direction of transference.

Figure 5:
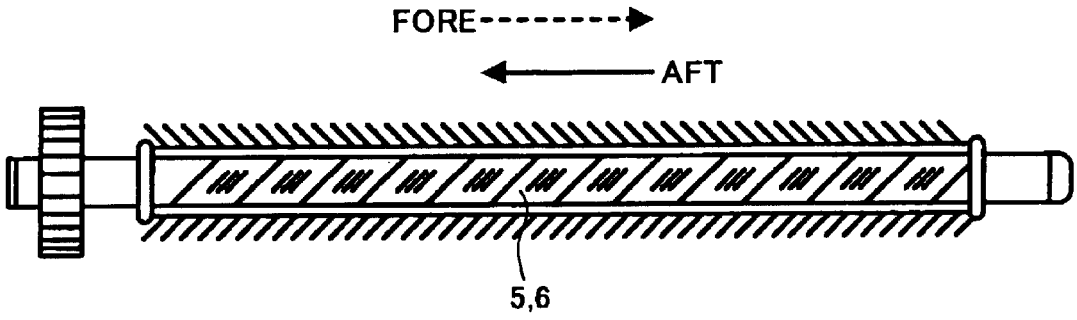
FIG. 5 is an explanatory diagram that shows the relative positions of a toner transferring screw and a cleaning brush.

To improve the cleaning performance, a cleaning aiding lubricant such as zinc stearate is externally added to the toner. The front of the photosensitive drum 2 in the direction of transference has a lot of lubricant adhering to it. After the toner image is transferred to a transfer material, the cleaning blade 11 and the cleaning brush 12 scrape off the toner remaining on the photosensitive drum 2. The direction of transference of the toner on the photosensitive drum 2 depends on the direction of the slant of the bristle on the cleaning brush 12. As shown in FIG. 5, the direction of the bristle on the cleaning brush 12 shown by the solid arrow marked 'Aft' is set in such a way that it is opposite to the direction of the transference of toner by the toner transferring screw 5, indicated by the dotted line arrow that is marked 'Fore'

By this arrangement, the toner is transferred towards the back on the photosensitive drum 2, the lubricant in the toner is also transferred towards the back, thereby eliminating the difference in the photosensitive layer of the photosensitive drum 2 between the front and the back.

Figure 4:
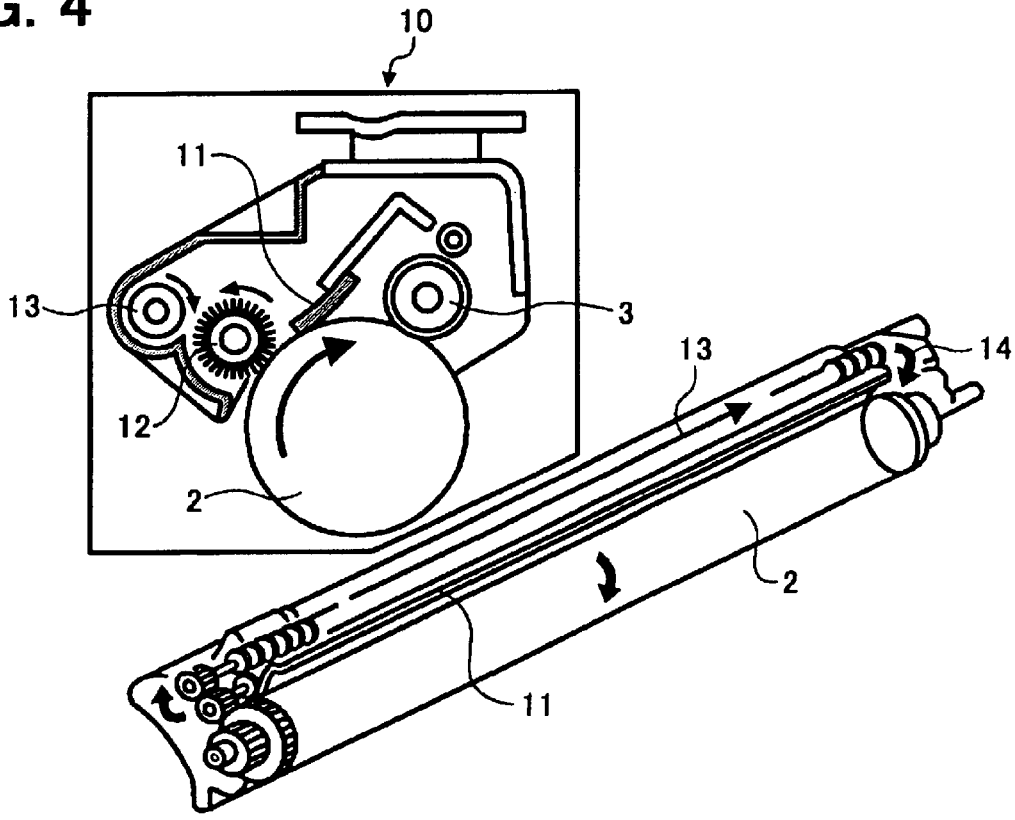
FIG. 4 is a working explanation of a cleaning unit.

The excess toner scraped off the photosensitive drum 2 moves in the excess toner removing coil 13 from the front to the back, as shown in FIG. 4, and is expelled outside through the outlet for excess toner 14. Because the excess toner removing coil 13 is disposed above the cleaning brush 12, the excess toner is not properly expelled and tends to accumulate inside the cleaning unit 10. This is avoided by making the bristle on the cleaning brush 12 slant in the direction opposite to the direction of transference of the excess toner inside the excess toner removing coil 13.

According to the present invention, the cleaning brush 12 has bristles that slant in the direction opposite to the direction of the developer transference by the transferring screws 5, 6. This helps smooth transfer of the toner on to the photosensitive drum 2 towards the back in the direction of transference, thereby eliminating the causes of unevenness of toner pickup by the cleaning blade 11. That is, by removing the difference in the frictional resistance between the cleaning blade 11 and the photosensitive drum 2, and by removing the difference in the rate at which scraping of the photosensitive layer of the photosensitive drum 2 takes place in the front and the back.

According to the present invention, a cleaning brush 12 has bristles that slant in the direction that is opposite to the direction of excess toner transference in the excess toner removing coil 13. This improves removal of excess toner and prevents accumulation of excess toner inside the cleaning unit 10.

The present document incorporates by reference the entire contents of Japanese priority document, 2002-052716 filed in Japan on Feb. 28, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a photosensitive drum;

a developing unit that causes a toner to adhere to the photosensitive drum, the developing unit including transferring screws that transfer a developer in the developing unit in a certain direction, and a developing roller situated near the transferring screws; and a cleaning unit that cleans excess toner on the photosensitive drum, the cleaning unit including a cleaning brush, wherein the cleaning brush has bristles that slant in a direction opposite to a direction of the developer transference by the transferring screws.

2. An image forming apparatus comprising:

a photosensitive drum;

a developing unit that causes a toner to adhere to the photosensitive drum; and a cleaning unit that cleans excess toner on the photosensitive drum, the cleaning unit including an excess toner removing coil that transfers excess toner in a certain direction, and a cleaning brush, wherein the cleaning brush has bristles that slant in the a direction that is opposite to a direction of excess toner transference in the excess toner removing coil.

* * * * *